US008388772B2

(12) United States Patent
Hagedorn et al.

(10) Patent No.: US 8,388,772 B2
(45) Date of Patent: Mar. 5, 2013

(54) PRESS ROLLER ANNULAR CASING AND METHOD

(75) Inventors: Alexander Hagedorn, Pulheim (DE); Meinhard Frangenberg, Kurten-Engeldorf (DE); Dieter Brendler, Bergisch Gladbach (DE)

(73) Assignee: KHD Humboldt Wedag GmbH, Cologne (DE)

( * ) Notice: Subject to any disclaimer, the term of this patent is extended or adjusted under 35 U.S.C. 154(b) by 272 days.

(21) Appl. No.: 12/944,915

(22) Filed: Nov. 12, 2010

(65) Prior Publication Data

US 2011/0061773 A1 Mar. 17, 2011

Related U.S. Application Data

(62) Division of application No. 11/662,350, filed as application No. PCT/EP2005/009574 on Sep. 7, 2005, now Pat. No. 7,832,671.

(30) Foreign Application Priority Data

Sep. 9, 2004 (DE) ..... 10 2004 043 562

(51) Int. Cl.
*C22F 1/10* (2006.01)

(52) U.S. Cl. ..... 148/522; 241/293

(58) Field of Classification Search ..... 148/522; 241/293

See application file for complete search history.

(56) References Cited

U.S. PATENT DOCUMENTS

| | | | |
|---|---|---|---|
| 5,269,477 | A | 12/1993 | Buchholtz et al. |
| 5,312,056 | A | 5/1994 | Kastingschafer et al. |
| 6,203,588 | B1 | 3/2001 | Schroder |

FOREIGN PATENT DOCUMENTS

| | | | |
|---|---|---|---|
| EP | 0516952 | A1 | 12/1992 |
| EP | 0563564 | A2 | 6/1993 |
| EP | 0916407 | | 5/1999 |

OTHER PUBLICATIONS

T. Yanaka, "Manufacture of Roll Sleeves", Iron and Steel Society, Rolls for the Metalworking Industries Publication, 1990, Chapter 9, pp. 121-134.

Gußeisen mit Kugelgraphit, 1988, pp. 13-16.

International Search Report dated Nov. 25, 2005, of PCT priority application PCT/EP2005/009574 filed Sep. 7, 2005.

*Primary Examiner* — Weiping Zhu

(74) *Attorney, Agent, or Firm* — Greer, Burns & Crain, Ltd.

(57) ABSTRACT

A method for the production of an annular casing for the press rollers of roller presses for the pressure comminution of particulate material, the outer surface of which casing always has a high degree of hardness and consequently a high wear-resisting capability, but the radially inner region of which casing has a lower degree of hardness to avoid casing ruptures. The annular casing is cast of nodular cast iron with at least the alloying elements Ni and Mo. The cast body is given a bainitic structure with residual austenite by a subsequent heat treatment followed by controlled cooling. The outer surface is constantly re-hardened during use via pressure loading such that martensite is constantly formed in boundary layers of the outer surface.

6 Claims, 1 Drawing Sheet

PRESS ROLLER ANNULAR CASING AND METHOD

BACKGROUND OF THE INVENTION

This application is a divisional of U.S. patent application Ser. No. 11/662,350 filed Jan. 9, 2008, incorporated by reference herein in its entirety.

The invention relates to an annular casing with a wear-resistant surface for a press roller for subjecting particulate material to pressure, in particular for roller presses for material-bed comminution. The invention also relates to a method for the production of such a press roller annular casing.

In the case of roller mills, particulate, brittle material to be ground is drawn into the roller nip, by which the two rotatably mounted, counter-rotatable rollers are separated from each other, and is subjected there to pressure comminution. Also known is so-called material-bed comminution in the roller nip of a high-pressure rolling mill, also known as a rolling press, in which the individual particles of the material to be ground that is drawn into the roller nip by friction are squeezed against one another in a bed of material, i.e. in a charge of material compressed between the two roller surfaces, when a high pressure is applied. The surfaces of the rollers thereby undergo a high level of wearing stress. Therefore, such roller surfaces have to meet at least the following requirements:

They should have high wear resistance, be able to be produced at low cost, be able to be repaired by the operator of the rolling press and also have good drawing-in characteristics for the material to be comminuted.

The article in the technical journal "ZKG International, No. 7/1997, pages 384 to 392 discloses on page 384, paragraph 1, with respect to wear protection in the case of high-pressure roller presses that roller casings of chilled cast iron may be advantageous because of their high compressive strength and that long service lives of the roller press can be achieved with casings of alloyed nodular cast iron, the term nodular cast iron being understood in material science as meaning cast iron with nodular graphite. Furthermore, it is known from the reprint from the technical journal "konstruieren+giessen" 1988, No. 1, from the Zentrale für Gu ß verwendung, Dusseldorf, with the article "Gusseisen mit Kugelgraphit" [cast iron with nodular graphite] (ductile cast iron), pages 13-16, to impart high ductility and compressive strength to the nodular cast iron by a special heat treatment, known as bainitic hardening.

It is known from EP-A 0 563 564 and EP-A 0 916 407 to produce the chilled cast-iron roller shell of a grinding roller from a bainitic cast iron alloy and, in order to increase the wear resistance and the ability to draw in material to be ground, to apply a surface profiling of hard surfacing materials on the outer circumferential surface of the roller shell. Although surfacing beads are capable of helping to improve the characteristics for drawing in feedstock, they are not capable of autogenous wear protection, because surfacing beads with their typical rounded profile cannot detain for any length of time the material that gets into the interstices between the beads.

Finally, it is known from EP-B 0 516 952, FIG. 2, to make the roller surface of roller presses more resistant to wear by arranging on the roller surface a multiplicity of prefabricated hard metal bodies, such as stud bolts for example, which can be incorporated in corresponding blind-hole bores of the roller shell. In the case of this so-called grid armouring, stud bolts protrude outward from the roller surface to such a great height and are arranged at such a distance from one another that, when the roller press is in operation, on the roller surface the interstices between the stud bolts remain filled with the pressed-together fine-grained material, which forms autogenous wear protection for the roller surfaces and, on account of its roughness, also has good drawing-in characteristics. This known roller surface reinforcement with alternating zones of highly wear-resistant material and intermediate spatial zones of other wear resistance has proven to be successful in practice in the material-bed comminution of ore material in particular.

SUMMARY OF THE INVENTION

The invention is based on the object of providing an annular casing, in particular for the press rollers of roller presses for the pressure comminution of particulate material, the outer surface of which casing always has a high wear resisting capability, without having to use incorporated hard metal bodies such as for example powder-metallurgically produced stud bolts.

The material of the annular casing according to the invention for a press roller, in particular for the material-bed comminution of particulate material, is comprised of cast iron with nodular graphite and a bainitic structure with residual austenite, the characteristics of this material being adjusted in such a way that it has such a ductility that the annular casing, the wall thickness of which may be up to approximately 500 mm, can be firmly shrink-fitted onto the basic body of the roller with roller journals without the risk of rupture. It has surprisingly been found that external pressure loading of the heating surface has the effect that a casting material hardens on its surface and in its boundary layers by the formation of martensite. That is to say that, in the case of the annular casing according to the invention, the greatest hardness and wear resistance is substantially on the surface and in the boundary layers of the casing and not in the radially inner regions of the casing. The hardness in the boundary layers of the casing is constantly reformed and renewed when the roller machine is in operation until, after a long time in service, the casing has been worn down to the residual wall thickness necessary in terms of its structural design. The annular casing according to the invention therefore forms self-hardening boundary layers.

Spaced apart depressions are formed into the outer surface of the annular casing, for example formed during casting and/or formed by machining, in particular slot grinding, so that, when the roller machine is in operation, material to be treated is pressed into the slotted depressions of the profiled outer surface of the annular casing, remains there during the rotations of the roller, forms an autogenous wear protection for the casing surfaces and, on account of its roughness, also has good drawing-in characteristics. At the same time, the profiling projections of the casing surface that lie between the spaced-apart slotted depressions may still be reinforced by surfacing beads consisting of hard material. This additional reinforcement of the annular casing according to the invention does not create any problems, since the welding stresses produced during the surfacing are virtually neutralized by the dimensioning and geometrical distribution of the material elevations between the spaced-apart slots, and consequently the formation of welding cracks in the annular casing material is avoided in this way.

The method for producing the press roller annular casing for subjecting particulate material to pressure, in particular for roller presses for material-bed comminution, is characterized according to the invention by the annular casing first being cast from cast iron with nodular graphite and at least the alloying elements Ni and Mo while avoiding a pearlitic structure, and the cast body being given a bainitic structure with residual austenite by a subsequent heat treatment followed by controlled cooling, pressure loading of the outer surface of the annular casing when it is in operation having the effect that its outer boundary layers are constantly re-hardened with the formation of martensite. The forming of the surface profiling of the annular casing is accomplished in particular by slot grinding.

BRIEF DESCRIPTION OF THE DRAWINGS

The invention and its further features and advantages are explained in more detail on the basis of the exemplary embodiment schematically represented in the drawing, in which.

DETAILED DESCRIPTION OF THE PREFERRED EMBODIMENTS

Figure 1:
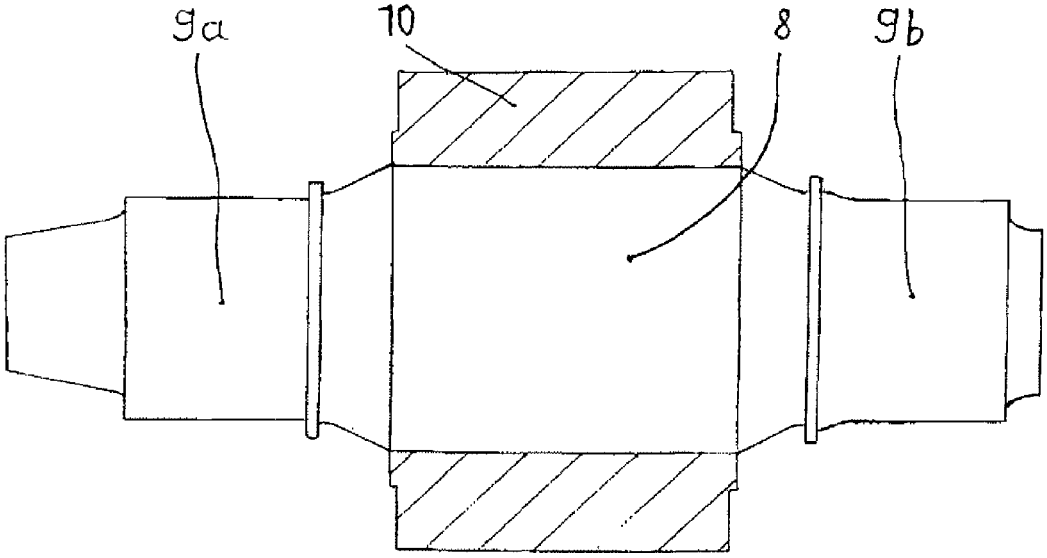
FIG. 1 shows the view of a press roller shaft of a material-bed comminuting roller press with a shrink-fitted annular casing, drawn in section.

According to FIG. 1, an annular casing 10 with a wall thickness of, for example, 170 mm to 500 mm, is fastened, in particular by shrink-fitting, on a basic roller body 8 with shaft journals 9*a*, 9*b*.

The material of the casing 10 is comprised of nodular cast iron with a bainitic structure and residual austenite. In the boundary layer 11 of the annular casing 10, the roller surface contains high proportions of martensite, which are constantly reformed, in particular when the press roller is in operation. The pressure occurring in the roller nip of the roller press during material-bed comminution may be, for example, greater than 100 MPa, and the specific pressing force may be, for example, 8 to 10 t/cm. The hardness of the annular casing according to the invention may be, for example, approximately 40 HRC. The hardness and wear resistance are constantly formed and renewed when the press roller is in operation until, after a long time in service, the annular casing is worn down.

Figure 2:
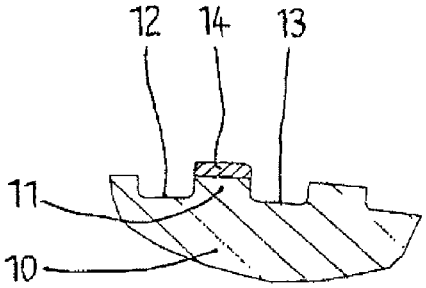
FIG. 2 shows an outer detail taken from the circumference of the annular casing of FIG. 1, shown in vertical section transversely in relation to the roller axis.

According to the depicted exemplary embodiment of FIG. 2, spaced-apart depressions, namely slots 12, 13, are formed into the outer surface of the annular casing 10, 11; they may be formed by the casting technique, but are produced in particular by machining such as slot grinding. At the same time, the profiling projections of the casing surface that lie between the spaced-apart depressions 12, 13 are also reinforced by hard surfacing beads 14 or by other hard materials.

The material pressed into the depressions 12, 13, with a slot width of for example 10 to 15 mm, during the material-bed comminution when the roller press is in operation forms an autogenous wear protection, whereby the wear resisting capability of the surface of the annular casing 10 according to the invention, which is in any case already high, is increased still further.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A method for producing a press roller annular casing for subjecting particulate material to pressure, comprising the steps:

a) casting the annular casing from cast iron with nodular graphite and at least the alloying elements Ni and Mo, b) giving the cast body a bainitic structure with residual austenite by a subsequent heat treatment followed by controlled cooling, c) forming spaced-apart depressions into the outer surface of the annular casing by one of casting and machining, before the annular casing is used in a roller press, and d) constantly re-hardening the outer surface of the annular casing during use via pressure loading such that martensite is constantly formed in boundary layers of the outer surface.

2. The method according to claim 1, wherein the step of forming spaced-apart depressions is accomplished by slot grinding.

3. The method according to claim 1, wherein the step of casting the annular casing comprising casting a wall thickness of up to approximately 500 mm and then shrink-fitting the casing on a basic roller body with shaft journals.

4. The method according to claim 1, including the step of applying surfacing beads comprising hard materials on top of the outer surface materials between the spaced-apart depressions.

5. A method for producing a press roller having an annular casing with a wear-resistant outer surface, for subjecting particulate material to pressure, comprising the steps:

a) casting the annular casing from cast iron with nodular graphite and at least the alloying elements Ni and Mo with a thickness of up to approximately 500 mm, b) giving the cast body a bainitic structure with residual austenite by a subsequent heat treatment followed by controlled cooling, c) shrink-fitting the annular casing on a basic roller body with shaft journals, d) forming spaced-apart depressions into the outer surface of the annular casing by one of casting and machining, before the annular casing is used in a roller press, e) applying surfacing beads comprising hard materials on top of the outer surface materials between the spaced-apart depressions, and f) constantly re-hardening the outer surface of the annular casing during use via pressure loading such that martensite is constantly formed in boundary layers of the outer surface.

6. The method according to claim 5, wherein the step of forming spaced-apart depressions is accomplished by slot grinding.

* * * * *